US010214994B2

(12) United States Patent
Manning et al.

(10) Patent No.: US 10,214,994 B2
(45) Date of Patent: Feb. 26, 2019

(54) DOWNHOLE ARRANGEMENT

(71) Applicant: Petrowell Limited, Aberdeen (GB)

(72) Inventors: Matthew Manning, Aberdeen (GB); Daniel George Purkis, Aberdeen (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 232 days.

(21) Appl. No.: 14/776,907

(22) PCT Filed: Mar. 14, 2014

(86) PCT No.: PCT/GB2014/050776
§ 371 (c)(1),
(2) Date: Sep. 15, 2015

(87) PCT Pub. No.: WO2014/140602
PCT Pub. Date: Sep. 18, 2014

(65) Prior Publication Data

US 2016/0032686 A1 Feb. 4, 2016

(30) Foreign Application Priority Data

Mar. 15, 2013 (GB) ..... 1304825.1

(51) Int. Cl.
*E21B 34/14* (2006.01)
*E21B 41/00* (2006.01)
*E21B 34/00* (2006.01)

(52) U.S. Cl.
CPC ..... *E21B 34/14* (2013.01); *E21B 41/00* (2013.01); *E21B 2034/007* (2013.01)

(58) Field of Classification Search
CPC ..... E21B 34/14; E21B 41/00; E21B 2034/007
See application file for complete search history.

(56) References Cited

U.S. PATENT DOCUMENTS 4,729,433 A 3/1988 Jacob
6,173,795 B1 * 1/2001 McGarian ..... E21B 21/10 166/321

(Continued)

FOREIGN PATENT DOCUMENTS

RU 2204688 C2 5/2003
RU 69560 U1 12/2007

(Continued)

OTHER PUBLICATIONS

Second Office Action in counterpart Canadian Appl. 2,899,861, dated Mar. 21, 2017.

(Continued)

*Primary Examiner* — D. Andrews
*Assistant Examiner* — Jonathan Malikasim
(74) *Attorney, Agent, or Firm* — Blank Rome LLP

(57) ABSTRACT

A downhole arrangement (32) comprises first (34) and second (41) members, a lock profile (4) fixed relative to one of the first and second members, and a lock member (10) for engaging the at least one lock profile. A release member (40) is provided which is moveable to selectively lock the lock member in engagement with the lock profile so as to selectively secure the second member relative to the first member. Such a downhole arrangement may permit a releasable connection between the first and second members.

34 Claims, 3 Drawing Sheets

(56) References Cited

U.S. PATENT DOCUMENTS

| | | | | |
|---|---|---|---|---|
| 2006/0208484 | A1 | 9/2006 | Swift | |
| 2009/0065214 | A1* | 3/2009 | Purkis | E21B 43/12 166/330 |
| 2011/0036590 | A1 | 2/2011 | Williamson et al. | |
| 2012/0067583 | A1* | 3/2012 | Zimmerman | E21B 34/14 166/308.1 |
| 2012/0247767 | A1* | 10/2012 | Themig | E21B 21/103 166/289 |

FOREIGN PATENT DOCUMENTS

| | | | |
|---|---|---|---|
| SU | 907225 | A1 | 2/1982 |
| SU | 1716099 | A1 | 2/1992 |

OTHER PUBLICATIONS

First Office Action in counterpart Canadian Appl. 2,899,861, dated Jun. 8, 2016.
Search Report and Office Action in counterpart RU Appl. 2015144046/03, dated Dec. 26, 1017, 7-pgs.
Examination Report in counterpart EP Appl. 14713237.7, dated Jul. 18, 2017.

* cited by examiner

DOWNHOLE ARRANGEMENT

FIELD OF INVENTION

The present invention relates to a downhole arrangement, for example to a downhole arrangement which provides a releasable connection between first and second members of a downhole tool.

BACKGROUND TO INVENTION

In many downhole tools it may be desirable to initially secure or fix components of such tools in an initial configuration. For example, sleeve components of a tool may be initially secured relative to each other or to a tool housing. Actuation of the tool may then rely on release of the initially secured component, thus requiring the use of one or more releasable connectors. Shear-type connectors are known in the art for this purpose. Such connectors provide a connection via a connection member, such as a screw or pin, which is configured to shear when exposed to a predetermined load. The successful operation of the tool may depend heavily on the reliability of the connection member, such as the accuracy of its shear rating and the like.

Also, a downhole tool may be configured such that a releasable connection, such as a shear-type connection, is released in response to a particular sequence of events, such as a particular order of movement of tool components. However, there may be a risk that a releasable connection may become released unintentionally at an instant in time which may cause failure of the tool. For example, there may be a risk that a releasable connection may become released prematurely, which may cause failure of the tool.

SUMMARY OF INVENTION

According to an aspect of the present invention there is provided a downhole arrangement.

The downhole arrangement may comprise first and second members.

The downhole arrangement may comprise a lock profile fixed relative to one of the first and second members.

The downhole arrangement may comprise a lock member for engaging the lock profile.

The downhole arrangement may comprise a release member which is moveable from a locking position in which the release member locks the lock member in engagement with the lock profile so as to prevent relative movement between the first and second members, to a release position in which the lock member is moveable relative to the lock profile so as to permit disengagement of the lock member from the lock profile and thereby permit relative movement between the first and second members.

It should be understood that one or more of the optional features disclosed in relation to one aspect of the invention may apply alone or in any combination in relation to a different aspect of the invention.

According to an aspect of the present invention there is provided a downhole arrangement comprising:

first and second members;

a lock profile fixed relative to one of the first and second members;

a lock member for engaging the lock profile; and a release member which is moveable to selectively lock the lock member in engagement with the lock profile so as to selectively secure the second member relative to the first member.

According to an aspect of the present invention there is provided a downhole arrangement comprising:

first and second members;

a lock profile fixed relative to one of the first and second members;

a lock member for engaging the lock profile; and a release member which is moveable between/from a locking position in which the release member locks the lock member in engagement with the lock profile so as to restrict relative movement between the first and second members, and/to a release position in which the lock member is moveable relative to the lock profile so as to permit disengagement of the lock member from the lock profile and thereby permit relative movement between the first and second members.

Such a downhole arrangement may permit a releasable connection to be formed between the first and second members. Relative movement between the first and second members may be prevented in the locking position. Movement of the release member from the locking position to the release position may permit relative movement between the first and second members, for example in response to a force applied to one or both of the first and second members. The force may, for example, be transferred to one or both of the first and second members through the release member.

The release member may be moveable relative to the one of the first and second members with respect to which the lock profile is fixed.

The downhole arrangement may be configured so that, when the release member is in the locking position, the lock member extends through the other of the first and second members, for example the lock member extends radially through the other of the first and second members.

The release member may be moveable under the action of an actuator such as an actuator sleeve.

The release member may be moveable under the action of a sleeve such as the indexing or collet sleeve disclosed in one or both of international patent applications published as WO 2011/117601 and/or WO 2011/117602 which are incorporated by reference herein.

The downhole arrangement may be configured so that the lock profile is fixed relative to the first member. The lock profile may be defined by a component which is fixed relative to the first member. The first member may define the lock profile.

The downhole arrangement may be configured so that the release member is moveable relative to the first member.

The downhole arrangement may be configured so that when the release member is in the locking position, the lock member extends through the second member.

The lock member may be configured to withstand the effects of friction and/or wear due to relative motion between the lock member and at least one of the lock profile, and the release member and the second member. The lock member may, for example, comprise, or be formed from a hardened material for this purpose.

The lock member may comprise a key member such as a pin, rod or the like.

The lock member may comprise a rolling body such as a roller, ball or the like. The lock member may comprise a rolling body. The use of a rolling body as a lock member may serve to assist in the relative movement between the release member and the first member. The use of a rolling body may, for example, serve to reduce friction between the release member and at least one of the lock profile, the release member and the second member.

The lock profile may be configured to receive at least a portion of the lock member. The lock profile may comprise a recess. The lock profile may be complementary to the lock member. The lock profile may comprise a race for a rolling body.

The first member may be generally tubular. The first member may comprise or define a sleeve.

The release member may be moveable from the locking position to the release position along an axial direction defined relative to a longitudinal axis of the first member.

The downhole arrangement may be configured so that when the release member is in the locking position, relative axial movement between the first and second members may be prevented.

The downhole arrangement may be configured so that when the release member is in the release position, relative axial movement between the first and second members is permitted.

The lock profile may be defined on an inner surface of an annular member. The annular member may be fixed, for example axially fixed, relative to the first member.

The downhole arrangement may be configured so that the second member extends at least partially within the first member.

The second member may comprise a sleeve having an aperture formed through a sidewall thereof, the aperture being configured to accommodate the lock member.

The downhole arrangement may comprise a plurality of lock members.

The second member may comprise a sleeve having a plurality of apertures formed through a sidewall thereof, each aperture being configured to accommodate a corresponding lock member.

The lock profile may comprise a circumferentially continuous recess arranged around a longitudinal axis defined by the first member. Such a recess may be configured for engagement by the lock member. Such a recess may be engaged by a plurality of circumferentially distributed lock members. Such a recess may permit one or more lock members to axially lock the first and second members whilst permitting relative rotation between the first and second members. The use of such a recess may simplify the assembly of the downhole arrangement because the use of such a recess would not require rotational alignment of the first and second members.

The lock profile may comprise a circumferentially discontinuous recess. Such a recess may be configured for engagement by the lock member. Such a recess may permit the lock member to lock the first and second members together so as to restrict relative axial or rotational motion therebetween. The lock member may lock the first and second members together so as to prevent any relative axial or rotational motion therebetween. This may be advantageous, for example, should it ever become necessary to drill out the downhole arrangement from a wellbore. If relative rotation between the first and second members were permitted, one of the first and second members may rotate with a drill bit used to drill out the downhole arrangement, preventing or at least hindering complete removal of the first or second member that rotates with the drill bit.

The downhole arrangement may comprise a plurality of discrete circumferentially distributed lock profiles. Each lock profile may be configured for engagement by a corresponding lock member. Such an arrangement of lock profiles may permit the lock members to lock the first and second members together so as to prevent any relative axial or rotational motion therebetween. The use of a plurality of lock members may provide a more robust locking action.

The release member may define a profile having a locking section and a release section. The locking section may support the lock member when the release member is in the locking position. The release section may de-support the lock member when the release member is in the release position.

The release member may define the profile on an outer surface thereof.

The locking section may be defined by a larger outer diameter or raised axial section of the outer surface of the release member.

The release section may be defined by a smaller outer diameter or lowered axial section of the outer surface of the release member.

The locking section and the release section may define a shoulder therebetween on the outer surface of the release member.

The downhole arrangement may be configured such that the release member is moveable from any one of a plurality of locking positions in each of which the release member locks the lock member in engagement with the lock profile so as to restrict, and optionally prevent, relative movement between the first and second members, to the release position.

The downhole arrangement may be configured such that the plurality of locking positions defines a range of locking positions, such as a continuous range of locking positions.

The size of the range of locking positions may be defined by the extent, for example the axial extent, of the locking section of the profile of the release member.

The downhole arrangement may be configured such that the release member is moveable from the locking position to any one of a plurality of release positions in each of which the lock member is moveable relative to the lock profile so as to permit disengagement of the lock member from the lock profile and thereby permit relative movement between the first and second members.

The downhole arrangement may be configured such that the plurality of release positions defines a range of release positions, such as a continuous range of release positions.

The size of the range of release positions may be defined by the extent, for example the axial extent, of the release section of the profile of the release member.

The downhole arrangement may be configured such that the release member is moveable from the locking position to a first release position at which the lock member first becomes moveable relative to the lock profile so as to permit disengagement of the lock member from the lock profile and thereby permit relative movement between the first and second members.

The release member may comprise or define a driving feature for engaging and driving the second member.

The downhole arrangement may be configured such that the driving feature of the release member engages the second member when the release member is in the first release position.

The downhole arrangement may be configured such that the driving feature of the release member engages the second member when the release member is in a release position which is separated from the first release position by a predetermined distance. This may permit disengagement of the lock member from the lock profile and thereby permit relative movement between the first and second members before the release member engages the second member.

An initial position of the shoulder of the profile of the release member relative to the lock member may be selected so that the lock member is de-supported, thereby permitting disengagement of the lock member from the lock profile and enabling movement of the second member relative to the first member before the driving feature of the release member engages the second member. Such a configuration of the downhole arrangement may serve to provide that the second member is only enabled for movement relative to the first member following initial movement the release member towards its open position. This may serve to avoid unintentional movement and/or actuation of the second member at other times.

The downhole arrangement may comprise a releasable connector configured to restrict, and optionally prevent, relative movement between the first and second members when connected. The releasable connector may be released upon application of a predetermined force. Such a releasable connector may serve to reduce the risk of any unintentional movement and/or actuation of the second member.

The downhole arrangement may comprise a frangible connector configured to restrict, and optionally prevent, relative movement between the first and second members for shear forces between the first and second members less than a predetermined shear force limit and to permit relative movement between the first and second members for shear forces between the first and second members in excess of the shear force limit. The releasable connector may be or comprise a frangible connector.

The frangible connector may comprise a shear pin or a shear screw.

The release member may be moveable from the release position to the locking position. Such an arrangement may be used to permit relative movement between the first and second members at a first time and prevent relative movement between the first and second members at a second time later than the first time.

The downhole arrangement may comprise at least a portion of a downhole tool such as a downhole tool for fluid injection into a subterranean formation such as a hydrocarbon bearing formation. The downhole arrangement may comprise at least a portion of a downhole tool configured for stimulating or fracturing a subterranean formation.

The downhole arrangement may comprise at least a portion of a downhole tool for fluid production from a subterranean formation such as a hydrocarbon bearing formation.

The first member may comprise a first component of the downhole tool.

The first member may comprise a housing of the downhole tool.

The first member may define at least one fluid port through a sidewall thereof.

The second member may comprise a second component of the downhole tool.

The second member may comprise a catcher for an object such as a ball, dart, plug or the like.

The second member may comprise a plurality of collet fingers.

The release member may comprise a sleeve.

The release member may comprise a valve sleeve.

The release member may be configurable to open a fluid port defined by the first member, such as a fluid port defined through a sidewall of the first member.

The release member may be moveable relative to the first member so as to open or reveal a port defined by the first member, such as a fluid port defined through a sidewall of the first member.

The release member may define at least one fluid port through a sidewall thereof.

The release member may movable relative to the first member so as to align at least one of the fluid ports defined by the release member with at least one of the fluid ports define by the first member.

It should be understood that one or more of the optional features disclosed in relation to one aspect of the invention may apply alone or in any combination in relation to a different aspect of the invention.

According to an aspect of the present invention there is provided a method for releasably connecting first and second members of a downhole arrangement.

The method may comprise fixing a lock profile relative to one of the first and second members.

The method may comprise moving a release member from a locking position in which the release member locks a lock member in engagement with the lock profile so as to prevent relative movement between the first and second members to a release position in which the lock member is moveable relative to the lock profile so as to permit disengagement of the lock member from the lock profile and thereby permit relative movement between the first and second members.

It should be understood that one or more of the optional features disclosed in relation to one aspect of the invention may apply alone or in any combination in relation to a different aspect of the invention.

According to an aspect of the present invention there is provided a method for releasably connecting first and second members of a downhole arrangement, the method comprising:

fixing a lock profile relative to one of the first and second members; and moving a release member to selectively lock a lock member in engagement with the lock profile so as to selectively secure the second member relative to the first member.

It should be understood that one or more of the optional features disclosed in relation to one aspect of the invention may apply alone or in any combination in relation to a different aspect of the invention.

According to an aspect of the present invention there is provided a method for releasably connecting first and second members of a downhole arrangement, the method comprising:

fixing a lock profile relative to one of the first and second members; and moving a release member from a locking position in which the release member locks a lock member in engagement with the lock profile so as to prevent relative movement between the first and second members to a release position in which the lock member is moveable relative to the lock profile so as to permit disengagement of the lock member from the lock profile and thereby permit relative movement between the first and second members.

It should be understood that one or more of the optional features disclosed in relation to one aspect of the invention may apply alone or in any combination in relation to a different aspect of the invention.

BRIEF DESCRIPTION OF DRAWINGS

These and other aspects of the present invention will now be described, by way of non-limiting example only, with reference to the accompanying drawings, of which.

DETAILED DESCRIPTION OF DRAWINGS

Figure 1A:
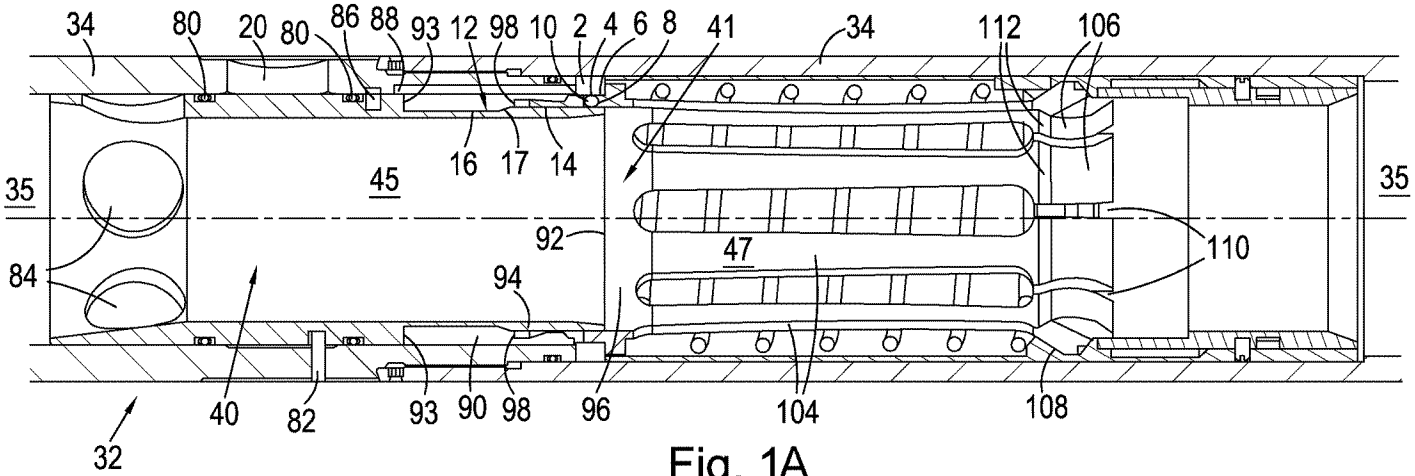
FIG. 1A is a cross-sectional view (with FIG. 1B a detail thereof) of a portion of a downhole tool which includes first and second members in a releasably connected or locked configuration.
Figure 1B:
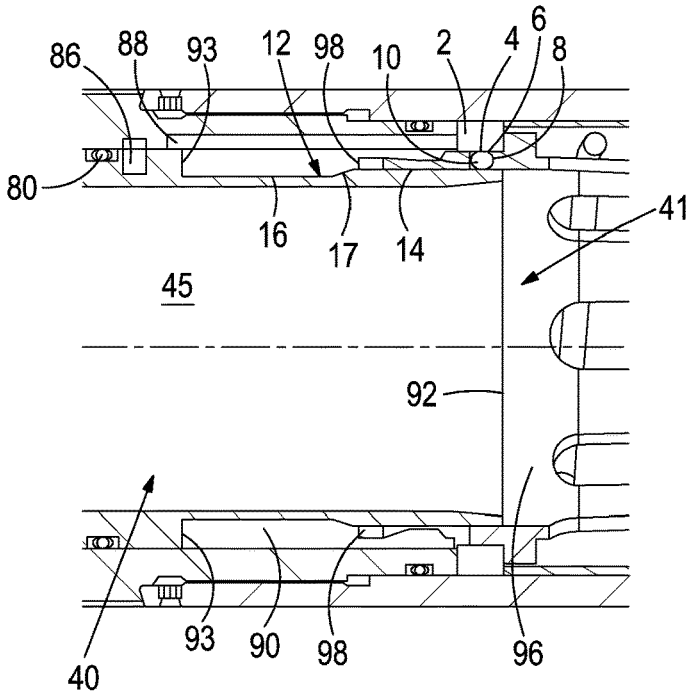

In the following description of FIGS. 1A to 3, references to an uphole direction refer to a direction to the left in FIGS. 1A to 3 and references to a downhole direction refer to a direction to the right in FIGS. 1A to 3. Referring initially to FIGS. 1A-1B, there is provided a downhole arrangement in the form of a tool portion generally designated 32 of a downhole tool. The tool portion 32 comprises a first member in the form of a housing 34 which defines a central bore 35.

Fluid ports 20 are provided radially through a wall of the housing 34 in the region of the tool portion 32, wherein the ports 20, when opened, facilitate outflow of a fluid from the central bore 35 of the housing 34. The tool portion 32 includes a release member in the form of a valve sleeve 40 which is moveable axially along the housing 34 from a closed position in which the sleeve 40 blocks or closes the ports 20, as shown in FIGS. 1A-1B, to an open position. It should be understood that movement of the valve sleeve 40 towards its open position is achieved by an associated actuator portion (not shown in FIGS. 1A-1B) located on an uphole side of the tool portion 32.

Figure 4:
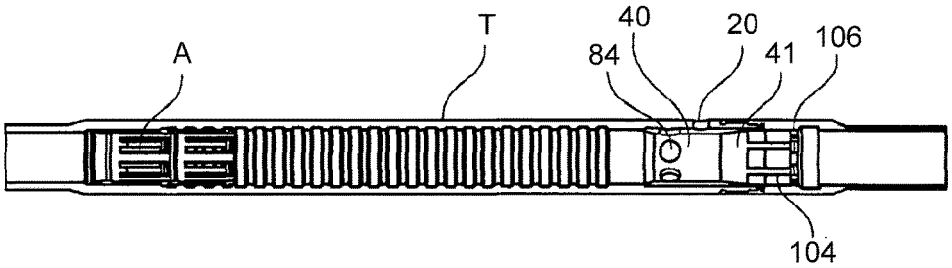
FIG. 4 is a cross-sectional view of a downhole tool having an actuator portion, a release member, and a catching sleeve according to the present disclosure.

The tool portion 32 further includes a second member in the form catching sleeve 41 located downhole of the valve sleeve 40. (FIG. 4 is a cross-sectional view of a downhole tool T having an actuator A, the release member or valve sleeve 40, and the catching sleeve 41 according to the present disclosure. As noted, the release member 40 may be moveable under the action of the actuator A, such as an actuator sleeve. In particular, the release member 40 may be moveable under the action of a sleeve A, such as the indexing or collet sleeve disclosed in one or both of international patent applications published as WO 2011/117601 and/or WO 2011/117602 incorporated by reference herein.)

The catching sleeve 41 is moveable from a free configuration, as shown in FIGS. 1A-1B and 2A-2B, in which a ball (not shown) may freely pass, to a catching configuration in which a ball 48 may be caught. The catching sleeve 41 may function to catch a ball and establish diversion of any fluid from the central bore 35 outwardly through the fluid ports 20 when open. Further, the catching sleeve 41 is operated to move to its catching configuration by movement of the valve sleeve 40 towards its open configuration. The form and operation of the valve sleeve 40 and catching sleeve 41 will be described in further detail below.

In FIGS. 1A-1B, the tool portion 32 is illustrated in an initial configuration, with the valve sleeve 40 in a closed position and the catching sleeve 41 in a free configuration. The following description will describe the various features of the tool portion 32 when in this initial configuration. A sequential operation to permit the tool portion 32 to be reconfigured from this initial configuration will then be provided.

The valve sleeve 40 defines a central bore 45, and the catching sleeve also defines a central bore 47, wherein the bores 45, 47 correspond to each other and with a central bore 35 of the housing 34.

When in its closed position the valve sleeve 40 blocks the fluid ports 20, by virtue of o-ring seals 80 positioned on opposing axial sides of the fluid ports 20 to facilitate sealing. The valve sleeve 40 is axially secured relative to the housing 34 via a number of shear screws 82 (only one shown in the particular cross-section of FIGS. 1A-1B). The valve sleeve 40 includes a plurality of ports 84. As will be described in more detail below, to move the valve sleeve 40 towards its open position an axial actuation force is applied by an actuator portion of the downhole tool (not shown in FIGS. 1A-1B, but shown as sleeve A in FIG. 4) to initially shear the screws 82 and align the sleeve ports 84 with the ports 20 in the housing 34. The valve sleeve 40 includes a key member 86 in an outer surface thereof which is received within a longitudinal key slot 88 provided in the inner surface of the housing 34. Interaction between the key 86 and slot 88 prevents relative rotation between the valve sleeve 40 and the housing 34, thus maintaining the sleeve ports 84 in the correct circumferential alignment relative to the ports 20 in the housing 34.

The valve sleeve 40 includes an annular recess 90 in an outer surface thereof, extending upwardly from a downhole axial end 92 and terminating at an annular load shoulder 93. Such a recess 90 defines an annular shroud 94 which in the illustrated configuration extends into the central bore 47 of the catching sleeve 41, and specifically is positioned inside an uphole axial end 96 of the catching sleeve 41, such that the uphole end 96 of the catching sleeve 41 is positioned within the annular recess 90 of the valve sleeve 40.

It has been recognised by the present inventors that a passing ball may not follow a perfect linear path through the tool portion 32, and in fact may continuously impact or ricochet off the inner surfaces of the tool portion 32. If such an impact were to occur against the end face 98 of the catching sleeve 41 then the impact force may be sufficient to cause actuation of the catching sleeve 41, and/or may cause damage to the catching sleeve 41. Accordingly, the shroud 94 physically isolates an uphole end face 98 of the catching sleeve 41, and thus functions to prevent a passing ball, or other object, from engaging the uphole end face 98 which may otherwise damage the catching sleeve 41, accidentally or prematurely cause actuation of the catching sleeve 41, or the like.

Although the shroud 94 isolates the uphole end face 98 of the catching sleeve 41, the shroud 94 does not prevent a passing ball, or other object, from engaging an internal surface of the catching sleeve 41. The impact of a passing ball, or other object, with the internal surface of the catching sleeve 41 may damage the catching sleeve 41, accidentally or prematurely cause actuation of the catching sleeve 41, or the like. Accordingly, the tool portion 32 is configured so that the catching sleeve 41 is releasably connected with respect to the housing 34 as will be described in more detail below.

The uphole axial end 96 of the catching sleeve 41 defines a plurality of apertures 8 in a sidewall thereof, wherein each aperture 8 is configured to accommodate a corresponding lock member in the form of a ball bearing 10. It should be understood that only one aperture 8 and one ball bearing 10 is shown in FIGS. 1A-1B. The tool portion 32 comprises an annular member 2 defining a lock profile in the form of a circumferentially continuous recess 4 on an inner surface 6 thereof. The recess 4 in configured for engagement by the ball bearings 10. The annular member 2 is fixed axially relative to the housing 34.

The shroud 94 of the valve sleeve 40 defines a profile generally designated 12 on an outer surface thereof. The profile 12 comprises a first larger outer diameter or raised section 14 which extends axially from the downhole axial end 92 of the shroud 94 to a shoulder 17 of the profile 12 and a second smaller outer diameter or lowered section 16 which extends axially from the shoulder 17 of the profile 12 to the load shoulder 93 of the valve sleeve 40.

When the valve sleeve 40 is in the initial locking position shown in FIGS. 1A-1B, the raised section 14 of the shroud 94 of the valve sleeve 40 supports the ball bearings 10, thereby locking the ball bearings 10 in engagement with the recess 4 and preventing axial movement of the catching sleeve 41 relative to the annular member 2. Since the annular member 2 is fixed axially relative to the housing 34, axial movement of the catching sleeve 41 relative to the housing 34 is thereby prevented.

Figure 2A:
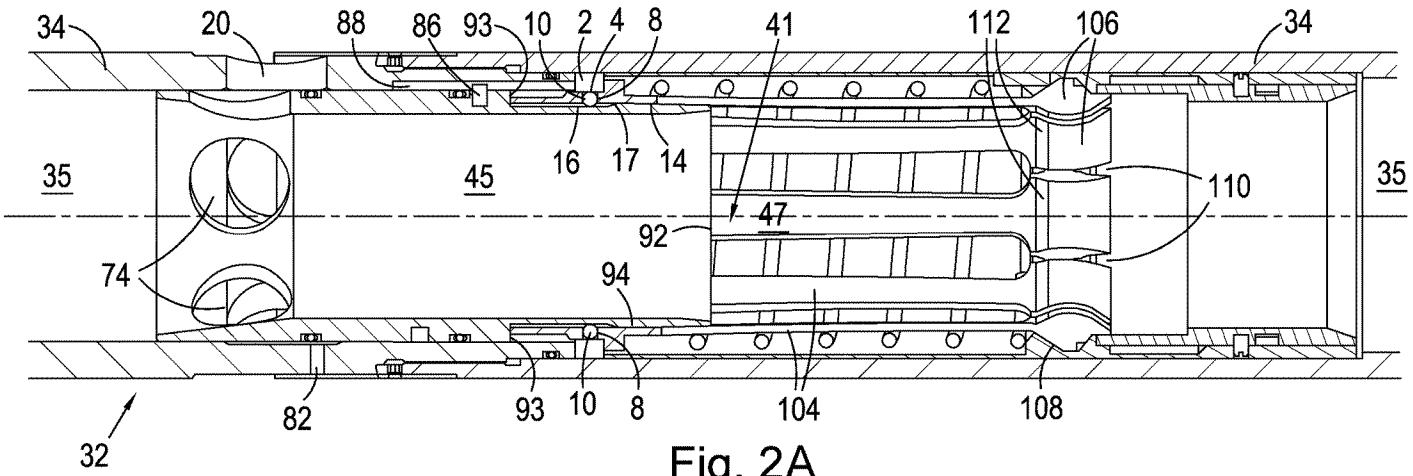
FIG. 2A is a cross-sectional view (with FIG. 2B a detail thereof) of the same tool portion of FIGS. 1A-1B, with the first and second members in a release configuration.
Figure 2B:
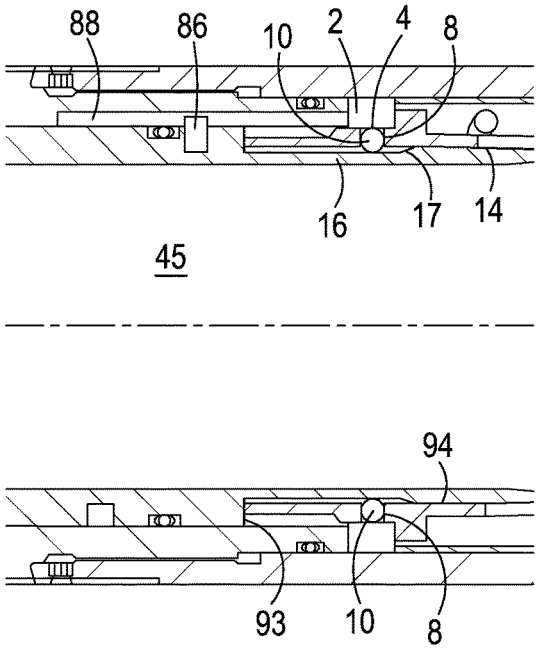

When it is desired to align the sleeve ports 84 with the ports 20 in the housing 34, for example to permit fluid flow from the central bore 35 to an environment surrounding the housing 34 or vice versa, a sufficient axial force is applied to the valve sleeve 40 in the downhole direction to shear the screws 82, for example using an associated actuator portion (not shown in FIGS. 1A-1B, but depicted as sleeve A in FIG. 4) located on an uphole side of the tool portion 32. Continued application of an axial force in the downhole direction may move the valve sleeve 40 towards its open position until the lowered section 16 of the profile 12 of the shroud 94 of the valve sleeve 40 is aligned with the ball bearings 10 as shown in FIGS. 2A-2B. The valve sleeve 40 is then in a release position. When in the release position, the lowered portion 16 of the shroud 94 of the valve sleeve 40 de-supports the ball bearings 10 permitting the ball bearings 10 to disengage from the recess 4, thereby permitting axial movement of the catching sleeve 41 relative to the annular member 2. Since the annular member 2 is fixed axially relative to the housing 34, axial movement of the catching sleeve 41 relative to the housing 34 is thereby permitted. Such a releasable connection arrangement between the catching sleeve 41 and the housing 34 may avoid any unintentional actuation of the catching sleeve 41 on the impact of a passing ball, or other object, with the internal surface of the catching sleeve 41.

When in the initial configuration shown in FIGS. 1A-1B, the catching sleeve 41 is positioned relative to the valve sleeve 40 such that an axial spacing or separation gap is defined between the load shoulder 93 of the valve sleeve 40 and the uphole end face 98 of the catching sleeve 41. Such initial separation may define a lost motion arrangement within the tool portion 32 as will be described in further detail below. That is, when axial movement of the valve sleeve 40 is initiated, the separation gap will be closed before eventual engagement between the load shoulder 93 of the valve sleeve 40 and the end face 98 of the catching sleeve 41, wherein subsequent axial load applied by the valve sleeve 40 may cause axial movement of the catching sleeve 41 towards its catching configuration, as will be described in further detail below.

The initial axial position of the shoulder 17 of the profile 12 of the valve sleeve 40 relative to the ball bearings 10 is selected so that the ball bearings 10 are de-supported, thereby permitting the disengagement of the ball bearings 10 from the recess 4 and enabling movement of the catching sleeve 41 relative to the housing 34 before the load shoulder 93 of the valve sleeve 40 engages the end face 98 of the catching sleeve 41. As such, the configuration of the tool portion 32 may serve to provide that the catching sleeve 41 is only enabled for movement relative to the housing following initial movement the valve sleeve 40 towards its open position, thereby avoiding unintentional actuation of the catching sleeve 41 at other times.

Figure 3:
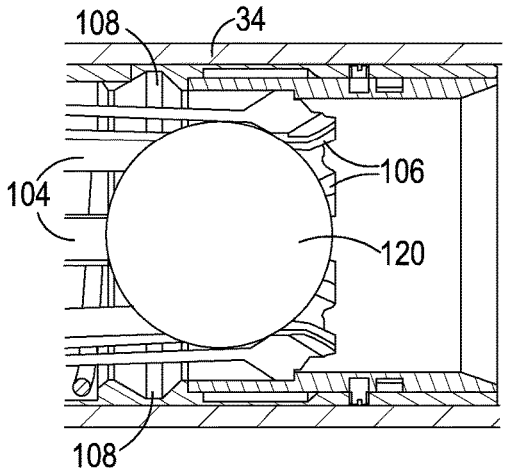
FIG. 3 is an enlarged view of an end portion of the tool portion of FIGS. 1A-1B, shown in an actuated state following release of the first and second members.

The catching sleeve 41 includes a plurality of collet fingers 104 extending longitudinally from the uphole tubular portion 96, wherein each collet finger 104 supports a seat member 106 on a distal end thereof. The collet fingers 104 are resiliently deformable, by longitudinal bending, to permit the seat members 106 to be selectively radially moveable relative to the central bore 47 of the catching sleeve 41. When the seat members 106 are positioned radially outwardly, as shown in FIGS. 1A-1B, a ball may pass without any contact or with minimal engagement with the seat members 106. However, when the seat members 106 are positioned radially inwardly, as will be described in more detail below, the seat members 106 collectively define a restriction within the central bore 47, and thus may be engaged by a passing ball. When the seat members 106 are positioned radially inwardly with the catching sleeve 41 configured in its catching configuration, a ball 120 may engage and seat against the seat members 106 and thus be caught within the catching sleeve 41 as shown in FIG. 3.

The tool portion 32 further comprises an annular recess 108 which is profiled to receive the seat members 106 when positioned radially outwardly. The collet fingers 104 provide a bias force such that the seat members 106 are biased radially outwardly and received within the annular recess 108, and thus positioned to permit passage of a ball. When the seat members 106 are positioned radially outwardly and located within the recess 108, a circumferential gap 110 is provided between adjacent seat members 106. When the seat members 106 are moved radially inwardly, these circumferential gaps 110 are closed, and in some embodiments adjacent seat members 106 are engaged or are positioned in very close proximity relative to each other, defining a substantially continuous annular structure.

Each seat member 106 includes an uphole seat surface 112 configured to be engaged by a ball when travelling in a downhole direction. The uphole seat surfaces 112 may be configured to provide a substantially complete or continuous engagement with a ball 120. Such an arrangement may facilitate sealing between a ball 120 and the seat members 106. Such sealing may permit the ball 120 to be sealingly engaged within the catching member 41 and thus substantially seal the central bore 47. This may allow appropriate fluid diversion from the central bore through the fluid ports 20. Such sealing against the seat members 106 may permit control of pressure uphole of the catching sleeve 41. Further, such sealing of the ball 120 within the catching sleeve 41 may permit the catching sleeve 41 to be actuated, for example by a pressure differential established between uphole and downhole sides of the catching sleeve 41.

One skilled in the art will appreciate that various modifications may be made to the tool portion 32 without departing from the scope of the invention as defined by the claims. For example, rather than the annular member 2 defining a circumferentially continuous recess 4 on an inner surface there of, which recess 4 is configured for engagement by a plurality of ball bearings 10, the annular member 2 may define a circumferentially discontinuous recess which is configured for engagement by a ball bearing. In a further variant, the annular member 2 may define a plurality of discrete circumferentially distributed recesses, wherein each recess is configured for engagement by a corresponding one of the ball bearings 10. In contrast to the circumferentially continuous recess 4, such recesses would serve to prevent relative rotation between the catching sleeve 41 and the housing 34 when each ball bearing 10 is locked in engagement with a corresponding recess by the valve sleeve 40.

Rather than the lock members comprising ball bearings 10, each lock member may comprise a rolling body of any kind. For example, each lock member may comprise a roller, a ball or the like. In a further variant, each lock member may comprise a pin, rod or the like.

In addition to the releasable connection between the catching sleeve 41 and the housing 34 provided by the ball bearings 10 and the recess 4, the tool portion 32 may comprise a frangible connector such as a shear pin, which is configured to prevent relative axial motion between the catching sleeve 41 and the housing 34 on the application of a relative axial force between the catching sleeve 41 and the housing 34 below a threshold force, but which is configured to permit relative axial motion between the catching sleeve 41 and the housing 34 on the application of a relative axial force in excess of the threshold force. The use of such a frangible connector may serve to further reduce the risk of unintentional actuation of the catching sleeve 41.

The invention claimed is:

1. A downhole arrangement comprising:

first and second members;

a lock profile fixed relative to one of the first and second members;

a lock member for engaging the lock profile; and a release member comprising a profile having a locking section and a release section, the release section being moveable between a locking position in which the locking section of the release member supports the lock member to lock the lock member in engagement with the lock profile so as to restrict relative movement between the first and second members, and a release position in which the release section of the lock member de-supports the lock member such that the lock member is moveable relative to the lock profile so as to permit disengagement of the lock member from the lock profile and thereby permit relative movement between the first and second members, the release member comprising a driving feature for engaging the second member when the release member is in the release position to permit the release, member to drive the second member relative to the first member.

2. The downhole arrangement according to claim 1, wherein movement of the release member from the locking position to the release position permits relative movement between the first and second members in response to a force applied to one or both of the first and second members.

3. The downhole arrangement according to claim 2, wherein the force is transferred to one or both of the first and second members through the release member.

4. The downhole arrangement according to claim 1, wherein the release member is configured to be actuated under the action of an actuator.

5. The downhole arrangement according to claim 1, wherein the lock member comprises a key member.

6. The downhole arrangement according to claim 1, wherein the lock member comprises a rolling body.

7. The downhole arrangement according to claim 1, wherein the first member comprises or defines a sleeve.

8. The downhole arrangement according to claim 1, wherein the lock profile is defined on an inner surface of an annular member.

9. The downhole arrangement according to claim 1, wherein the downhole arrangement comprises a plurality of lock members.

10. The downhole arrangement according to claim 1, wherein the second member comprises a sleeve having one or a plurality of apertures formed through a sidewall thereof, each aperture being configured to accommodate a corresponding lock member.

11. The downhole arrangement according to claim 1, wherein the lock profile comprises a circumferentially continuous recess arranged about a longitudinal axis defined by the first member.

12. The downhole arrangement according to claim 1, wherein the lock profile comprises a circumferentially discontinuous recess.

13. The downhole arrangement according to claim 12, wherein the circumferentially discontinuous recess permits the lock member to lock the first and second members together so as to restrict relative axial or rotational motion therebetween.

14. The downhole arrangement according to claim 12, wherein each lock profile is engageable by a corresponding lock member.

15. The downhole arrangement according to claim 1, wherein the release member defines the profile on an outer surface thereof.

16. The downhole arrangement according to claim 1, wherein the locking section is defined by a larger outer diameter or raised axial section of the outer surface of the release member.

17. The downhole arrangement according to claim 1, wherein the release section is defined by a smaller outer diameter or lowered axial section of the outer surface of the release member.

18. The downhole arrangement according to claim 1, wherein the release member is moveable from any one of a plurality of locking positions to the release position, wherein in each locking position the release member locks the lock member in engagement with the lock profile so as to restrict relative movement between the first and second members.

19. The downhole arrangement according to claim 18, wherein the plurality of locking positions defines a continuous range of locking positions.

20. The downhole arrangement according to claim 19, wherein the release member defines the profile on an outer surface thereof and wherein the size of the range of locking positions is defined by the extent of the locking section of the profile of the release member.

21. The downhole arrangement according to claim 1, wherein the release member is moveable from the locking position to any one of a plurality of release positions in each of which the lock member is moveable relative to the lock profile so as to permit disengagement of the lock member from the lock profile and thereby permit relative movement between the first and second members.

22. The downhole arrangement according to claim 21, wherein the plurality of release positions defines a continuous range of release positions.

23. The downhole arrangement according to claim 22, when dependent on claim 15, wherein the size of the range of release positions is defined by the extent of the release section of the profile of the release member.

24. The downhole arrangement according to claim 1, wherein the release member is moveable from the locking position to a first release position at which the lock member first becomes moveable relative to the lock profile so as to permit disengagement of the lock member from the lock profile and thereby permit relative movement between the first and second members.

25. The downhole arrangement according to claim 1, wherein the downhole arrangement is configured such that the driving feature of the release member first engages the second member when the release member is in a first release position.

26. The downhole arrangement according to claim 1, wherein the downhole arrangement is configured such that the driving feature of the release member engages the second member when the release member is in a release position which is separated from the first release position by a predetermined distance.

27. The downhole arrangement according to claim 1, comprising a releasable connector which restricts relative movement between the first and second members when connected, wherein the releasable connector is released upon application of a predetermined force.

28. The downhole arrangement according to claim 1, wherein the release member is moveable from the release position to the locking position.

29. The downhole arrangement according to claim 1, comprising at least a portion of a downhole tool for use in fluid injection into a subterranean formation.

30. The downhole arrangement according to claim 1, comprising at least a portion of a downhole tool for fluid production from a subterranean formation.

31. The downhole arrangement according to claim 1, wherein the release member is configurable to open a fluid port defined by the first member.

32. The downhole arrangement according to claim 1, wherein the second member comprises a catcher for an object.

33. The downhole arrangement according to claim 1, wherein:

the first member comprises a housing of a downhole tool, and defines at least one fluid port through a sidewall thereof;

the release member comprises a valve sleeve, and defines at least one fluid port through a sidewall thereof; and the release member is moveable relative to the first member so as to align at least one of the fluid ports defined by the release member with at least one of the fluid ports defined by the first member.

34. A method for releasably connecting first and second members of a downhole arrangement, the method comprising:

fixing a lock profile relative to one of the first and second members; and moving a release member to selectively lock a lock member in engagement with the lock profile so as to selectively secure the second member relative to the first member, the release member comprising a profile having a locking section and a release section and wherein the locking section supports the lock member when the release member is in a locking position, and the release section de-supports the lock member when the release member is in a release position.

* * * * *